US008104849B1

(12) United States Patent
Urioste-Risso

(10) Patent No.: US 8,104,849 B1
(45) Date of Patent: Jan. 31, 2012

(54) EXPANDABLE TABLE DEVICE FOR DIAPER CHANGES

(76) Inventor: Claudia Urioste-Risso, Roselle Park, NJ (US)

( * ) Notice: Subject to any disclaimer, the term of this patent is extended or adjusted under 35 U.S.C. 154(b) by 129 days.

(21) Appl. No.: 12/497,494

(22) Filed: Jul. 2, 2009

(51) Int. Cl.
*A47B 85/00* (2006.01)

(52) U.S. Cl. ..... 312/241; 108/67

(58) Field of Classification Search ..... 108/39, 108/65–68, 91, 69, 102, 93; 312/241, 203, 312/237, 277; 160/222, 223, 134; 248/240.1, 248/244, 298.1, 144, 118.5; 52/29
See application file for complete search history.

(56) References Cited

U.S. PATENT DOCUMENTS

| | | | | | |
|---|---|---|---|---|---|
| 91,974 | A | * | 6/1869 | Simensen | 108/66 |
| RE3,949 | E | * | 5/1870 | Lenz | 108/67 |
| 527,077 | A | * | 10/1894 | Rollings | 108/65 |
| 541,504 | A | * | 6/1895 | Roberts | 108/60 |
| 1,126,611 | A | * | 1/1915 | Wright | 108/67 |
| 1,174,587 | A | * | 3/1916 | Kelly | 108/39 |
| 1,272,983 | A | * | 7/1918 | Menzo | 108/93 |
| 1,613,364 | A | * | 1/1927 | Thompson | 296/97.8 |
| 2,054,843 | A | * | 9/1936 | Weber | 312/273 |
| 2,287,626 | A | * | 6/1942 | Luebke, Jr. | 108/93 |
| 2,492,139 | A | * | 12/1949 | Eliason | 108/66 |
| 2,513,961 | A | * | 7/1950 | Ostrom | 359/851 |
| 2,597,277 | A | * | 5/1952 | Anderson | 312/317.3 |
| 2,672,384 | A | * | 3/1954 | Richards | 108/93 |
| 2,679,443 | A | * | 5/1954 | Gaines | 312/241 |
| 2,829,939 | A | * | 4/1958 | Hoppe | 312/241 |
| 2,884,293 | A | * | 4/1959 | Chrobersky | 108/93 |
| 3,072,453 | A | * | 1/1963 | Evans et al. | 312/317.3 |
| 3,565,153 | A | * | 2/1971 | Loos et al. | 160/202 |
| 3,578,061 | A | * | 5/1971 | Hascheck et al. | 160/202 |
| 3,636,548 | A | * | 1/1972 | Maruzzelli | 312/282 |
| 3,649,069 | A | * | 3/1972 | Zip | 296/97.7 |
| 3,680,942 | A | * | 8/1972 | Davis | 312/317.3 |
| 3,683,825 | A | * | 8/1972 | Sheldon | 108/33 |
| 3,692,191 | A | * | 9/1972 | Moore | 211/184 |
| 3,756,680 | A | | 9/1973 | Lerner | |
| 4,263,854 | A | * | 4/1981 | Moore et al. | 108/37 |
| 4,399,666 | A | * | 8/1983 | Sakutori | 62/265 |
| 5,083,512 | A | * | 1/1992 | Newhouse et al. | 108/50.02 |
| 5,156,195 | A | * | 10/1992 | Wehler et al. | 160/202 |
| 5,161,270 | A | | 11/1992 | Najmabadi | |
| 5,425,313 | A | * | 6/1995 | Rowan | 108/65 |
| 5,622,118 | A | * | 4/1997 | Rowan | 108/65 |
| 5,711,229 | A | * | 1/1998 | Piretti | 108/67 |
| 5,864,905 | A | | 2/1999 | Helmsderer | |
| 6,039,516 | A | * | 3/2000 | Diels | 409/134 |
| 6,085,668 | A | * | 7/2000 | Kanki | 108/65 |
| 6,134,726 | A | | 10/2000 | Lau | |
| 6,219,866 | B1 | * | 4/2001 | Pascal | 5/655 |
| 6,629,504 | B2 | * | 10/2003 | Stem | 108/13 |
| 6,732,660 | B2 | * | 5/2004 | Dame et al. | 108/50.01 |
| 6,854,142 | B2 | | 2/2005 | Lukomskiy | |
| D504,264 | S | | 4/2005 | Galeazzi et al. | |
| 2002/0104625 | A1 | * | 8/2002 | Wang | 160/222 |
| 2004/0250739 | A1 | * | 12/2004 | Yang | 108/67 |
| 2007/0033730 | A1 | | 2/2007 | Bean | |

* cited by examiner

*Primary Examiner* — Darnell Jayne
*Assistant Examiner* — Hiwot Tefera

(57) ABSTRACT

An expandable table device for allowing a user to change a baby's diaper or to care for the baby which is composed of a base, a storage compartment disposed in the base, and an expandable table component disposed in the base. The table component is composed of a plurality of wings that can be stacked atop each other and stored in the storage compartment, or the wings can be expanded from the storage compartment and unstacked so as to create a generally flat surface.

1 Claim, 6 Drawing Sheets

EXPANDABLE TABLE DEVICE FOR DIAPER CHANGES

FIELD OF THE INVENTION

The present invention features a table having an expandable surface that can expand and collapse into a cabinet. More particularly, the present invention is directed to an expandable table for allowing a user to change and/or care for a baby.

BACKGROUND OF THE INVENTION

Baby changing tables require that a user stand upright to change his/her baby. Parents or other care takers may be too tired to stand while changing the baby's diaper. The present invention features an expandable table for allowing a user to change and car for a baby.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
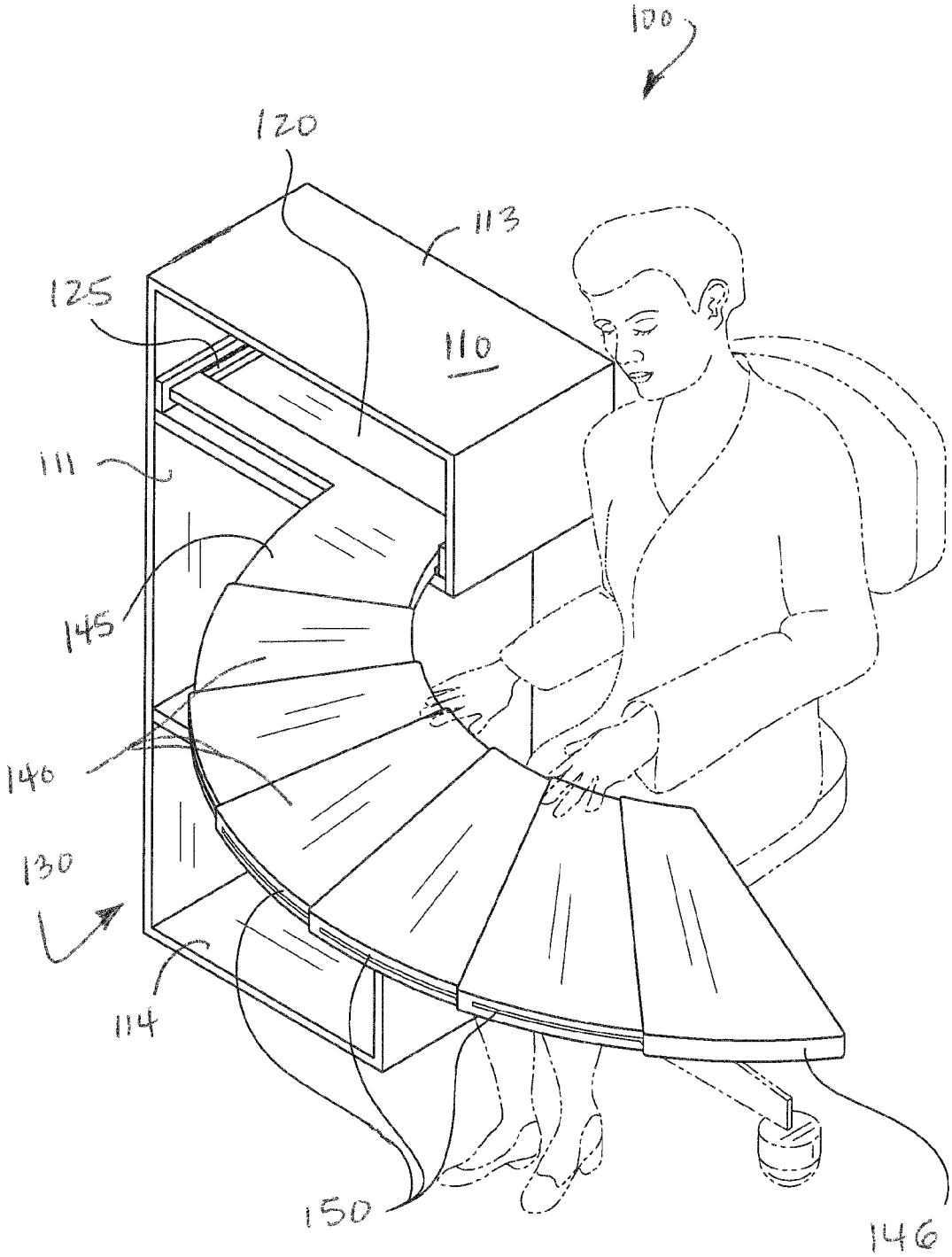
FIG. 1 is a perspective view of the expandable table device of the present invention, wherein the table component is expanded.
Figure 2:
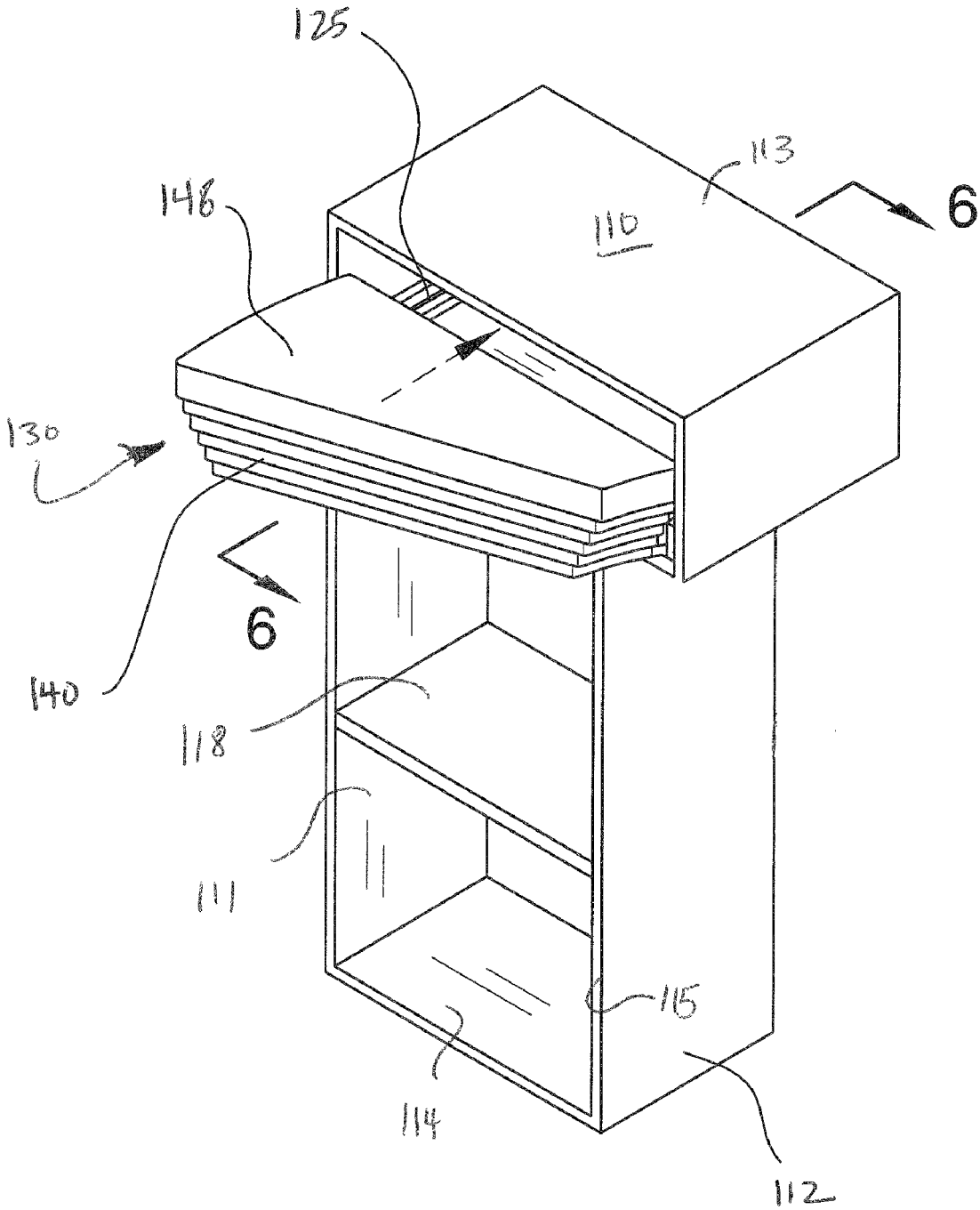
FIG. 2 is a perspective view of the expandable table device of the present invention, wherein the table component is retracted into the base.

The following is a listing of numbers corresponding to a particular element referred to herein:

100 expandable table device
110 base
111 first side panel
112 second side panel
113 top panel
114 bottom panel
115 front (open)
116 back panel
118 shelf
120 storage compartment for table component
125 track
130 table component
140 wing of table component (e.g., middle wing)
141 first side of wing
142 second side of wing
145 base wing
146 end wing

150 guide
155 guide lip
230 locking tab
240 locking groove
280 additional cabinet Referring now to FIGS. 1-7, the present invention features an expandable table device 100 for allowing a user to change and/or care for a baby. The expandable table device 100 comprises a base 110, similar to a standard cabinet in structure. Cabinets are well known to one of ordinary skill in the art. The base 110 comprises a first side panel 111, a second side panel 112, a top panel 113, a bottom panel 114, an open front 115, and a back panel 116. In some embodiments, one or more shelves 118 are disposed in the base (see FIG. 2).

Disposed near the top panel 113 is a storage compartment 120. The storage compartment 120 houses a table component 130. The table component 130 is expandable and retractable. For example, a user can pull the table component 130 out of the storage compartment 120 so as to provide a flat surface (e.g., for changing a baby). The table component 130 moves between an expanded position (see FIG. 1, FIG. 4) and a retracted position (see FIG. 2, FIG. 6).

The table component 130 comprises a base wing 145 slidably attached to a track 125 disposed inside the storage compartment 120. The track 125 allows the base wing 145 to slide in and out of the storage compartment 120.

One or more wings 140 (e.g., middle wings) are stackably linked to the base wing 145. For example, in some embodiments, the table component 130 comprises two wings 140. In some embodiments, the table component 130 comprises three wings 140. In some embodiments, the table component 130 comprises four wings 140. In some embodiments, the table component 130 comprises five wings 140. In some embodiments, the table component 130 comprises more than five wings 140. In some embodiments, an end wing 146 is the wing 140 farthest from the base wing 145.

Figure 6:
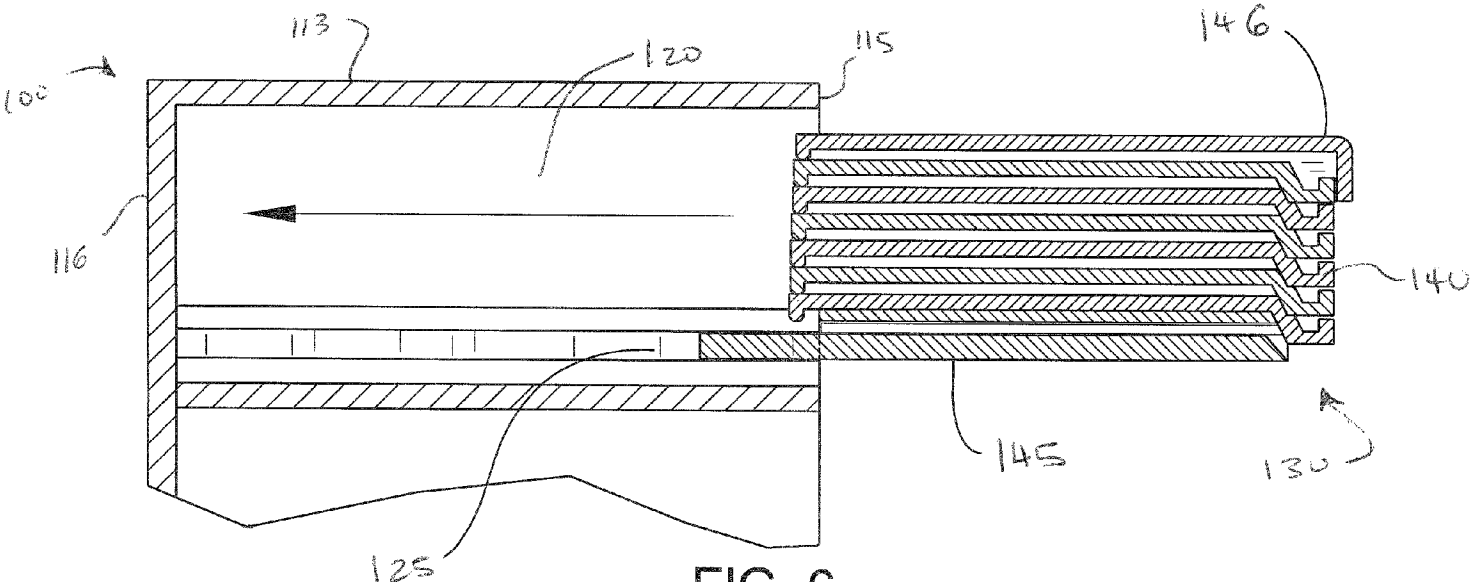
FIG. 6 is a second side cross sectional view of the expandable table device of the present invention.
Figure 7:
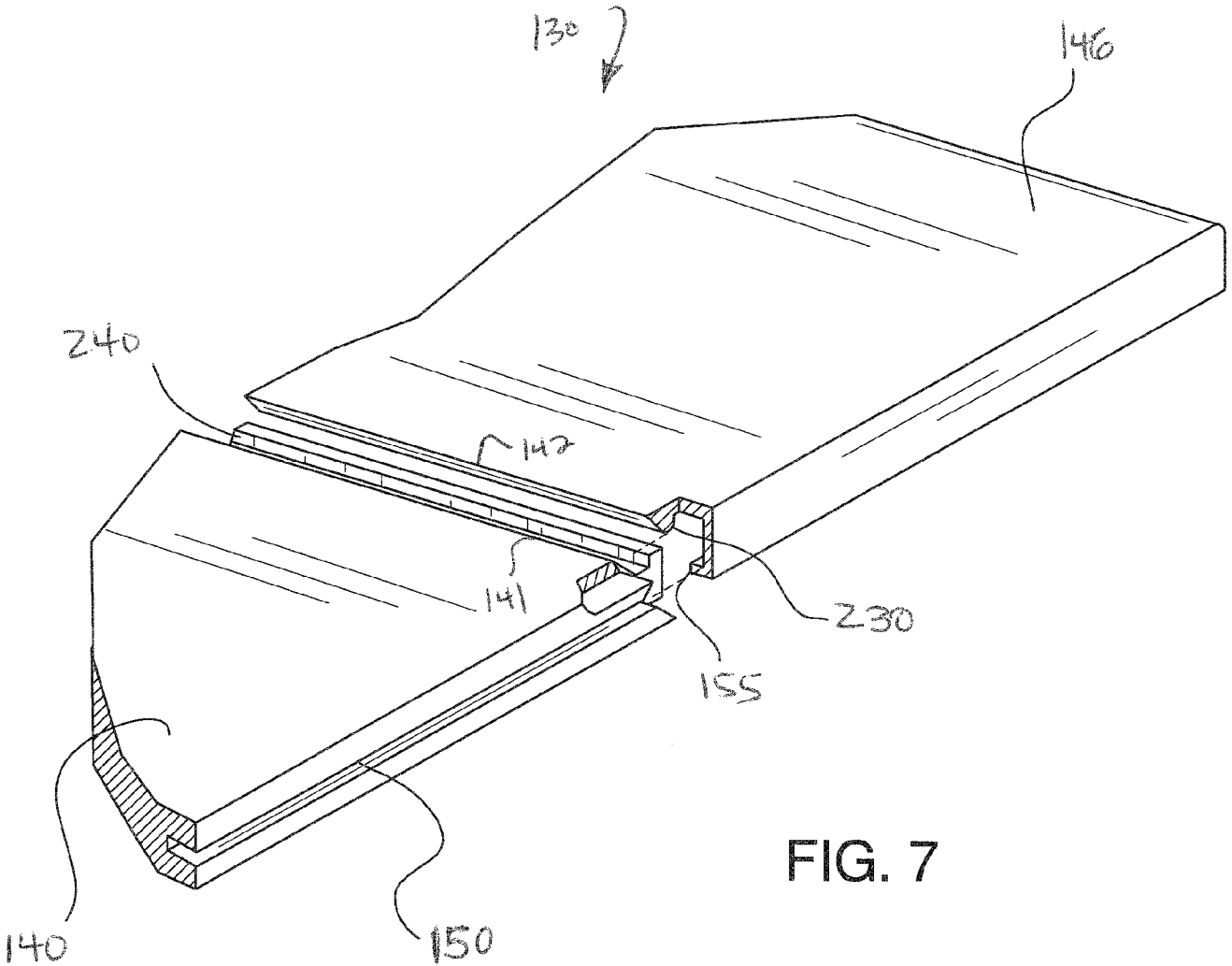
FIG. 7 is a perspective view of the expandable table device of the present invention.

As shown in FIG. 6, the wings 140 of the table component can stack atop one another. For example, a first wing may be atop the base wing 145, a second wing atop the first wing, a third wing atop the second wing, a fourth wing atop the third wing, a fifth wing atop the fourth wing, and an end wing 146 atop the fifth wing. The end wing 146 can be pulled outwardly from the remaining wings 140 (e.g., away from the storage compartment 120). As the wings 140 are pulled outwardly, they become unstacked and instead connect together to form a generally flat surface (see FIG. 1).

In some embodiments, the wings 140 each have a first side 141 and a second side 142. In some embodiments, a locking tab 230 is disposed on the second side 142 of the wing 140. In some embodiments, a locking groove 240 is disposed on the first side 141 of the wing. The locking groove 240 and locking tab 230 allow the wings 140 of the table component 130 to be secured together when they are expanded into the expanded position. For example, when a first wing is pulled away from a second wing, the locking tab 230 of the first wing interlocks with the locking groove 240 of the second wing (see FIG. 5, FIG. 7).

In some embodiments, the wings 140 of the table component 130 expand outwardly from the base 110 in a curved fashion (see FIG. 1). The curved shape allows a user to place a chair and sit behind the table component, while allowing the user to easily access all parts of the table component.

In some embodiments, each wing 140 has a top edge and a bottom edge. In some embodiments, a guide 150 is disposed in the top edge of the wing 140. The guide 150 allows the wings 140 to slide more easily atop each other or away from each other. For example, in some embodiments, the guide 150 comprises a lip 155, which allows adjacent wings 140 to slide atop or below that particular wing 140 (see FIG. 7).

Figure 3:
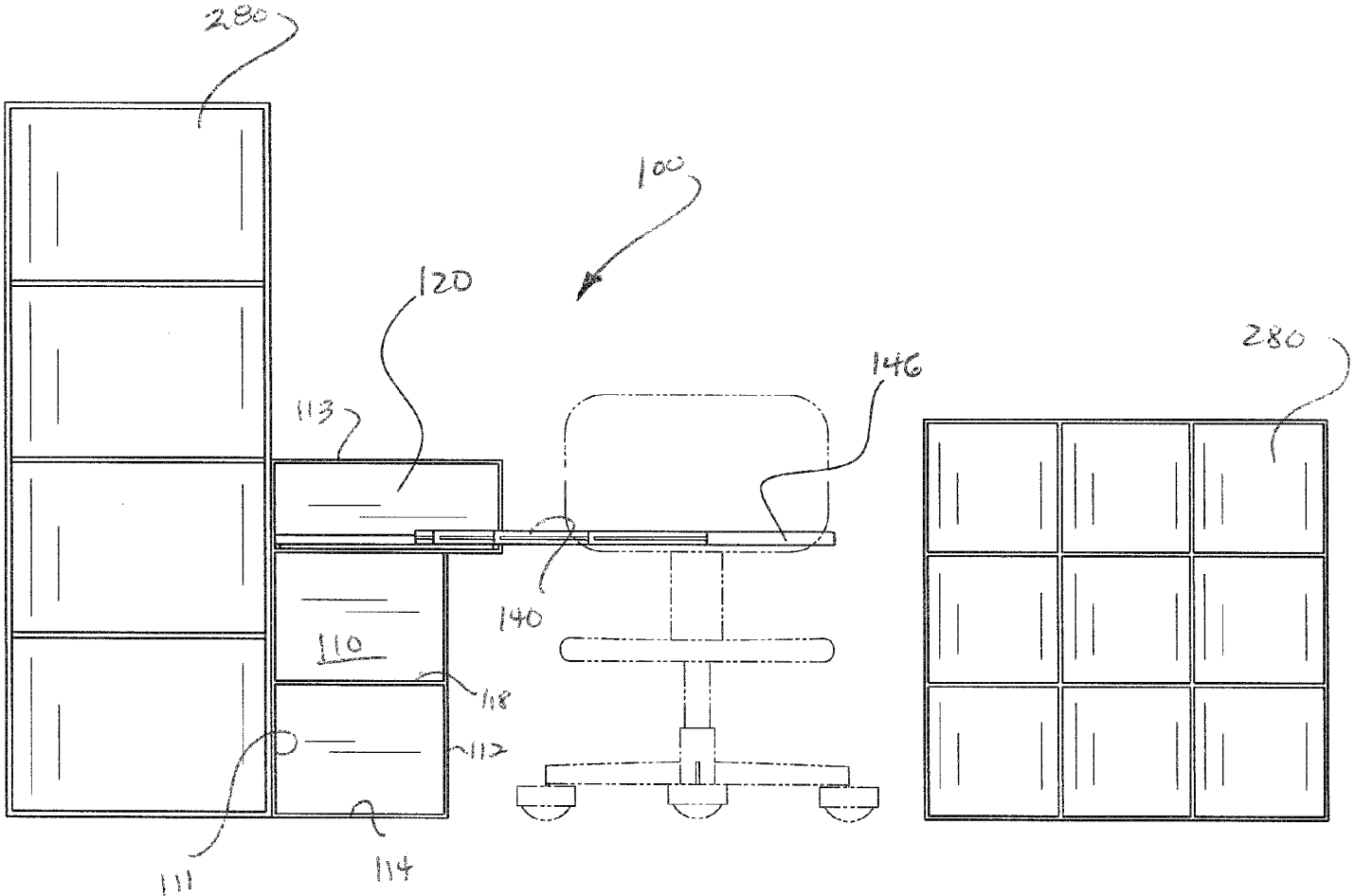
FIG. 3 is a front view of the expandable table device of the present invention.
Figure 4:
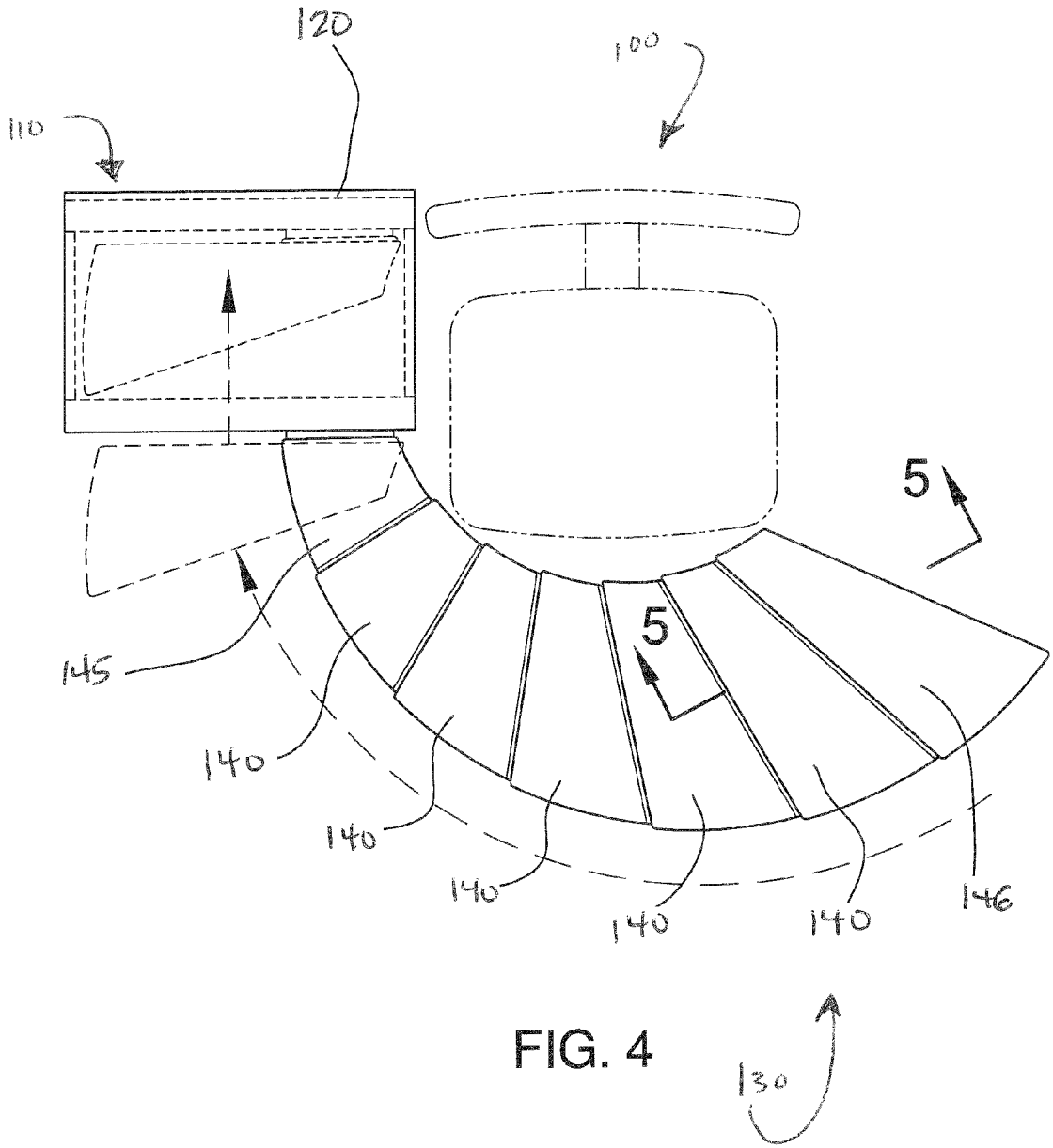
FIG. 4 is a top view of the expandable table device of the present invention.
Figure 5:
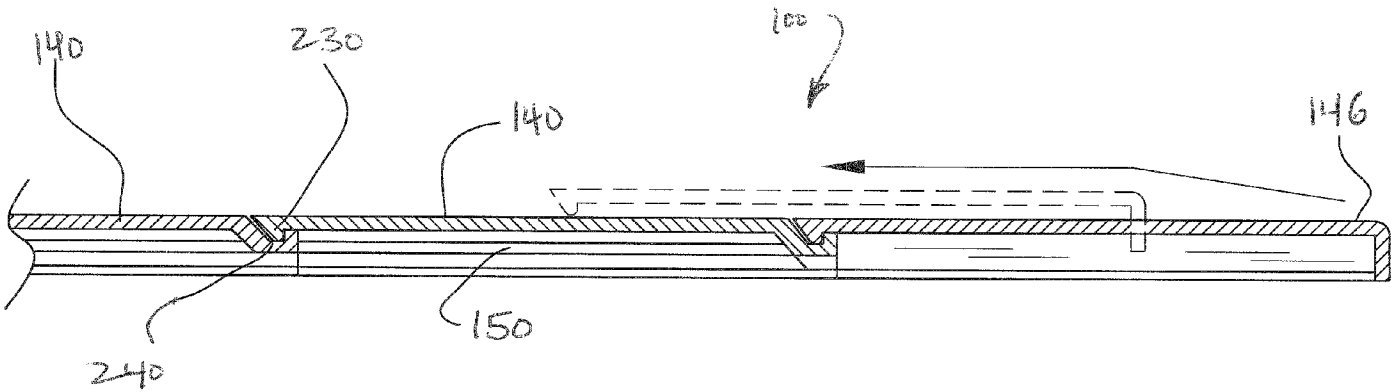
FIG. 5 is a first side cross sectional view of the expandable table device of the present invention.

In some embodiments, the expandable table device 100 is used in combination with one or more other cabinets 280 (see FIG. 3).

In some embodiments, a user can place a baby atop the table component 130. When he/she is finished changing and/or caring for the baby, he/she can push (e.g., retract) the table component 130 back into the storage compartment 120.

The expandable table device 100 of the present invention may be constructed from a variety of materials. For example, in some embodiments, the expandable table device 100 is constructed from a material comprising metal, wood, plastic, the like, or a combination thereof.

In some embodiments, the expandable table device 100 further comprises a fold-down leg for added stability.

The expandable table device 100 may be constructed in a variety of sizes. In some embodiments, the table component 130 is between about 2 to 4 feet in length as measured from the base wing 145 to the end wing 146. In some embodiments, the table component 130 is between about 4 to 6 feet in length as measured from the base wing 145 to the end wing 146. In some embodiments, the table component 130 is more than about 6 feet in length.

In some embodiments, the base 110 is between about 1 to 2 feet in width as measured from the first side panel 111 to the second side panel 112. In some embodiments, the base 110 is between about 2 to 4 feet in width as measured from the first side panel 111 to the second side panel 112. In some embodiments, the base 110 is more than about 4 feet in width.

In some embodiments, the base 110 is between about 2 to 4 feet in height as measured from the top panel 113 to the bottom panel 114. In some embodiments, the base 110 is between about 4 to 6 feet in height as measured from the top panel 113 to the bottom panel 114. In some embodiments, the base 110 is more than about 6 feet in height.

As used herein, the term "about" refers to plus or minus 10% of the referenced number. For example, an embodiment wherein the base 110 is about 5 feet in height includes a base 110 that is between 4.5 and 5.5 feet in height.

The disclosures of the following U.S. Patents are incorporated in their entirety by reference herein: U.S. Pat. No. 6,854,142; U.S. Pat. No. 5,161,270; U.S. Pat. No. 3,756,680; U.S. Pat. Application No. 2007/0033730; U.S. Pat. No. 5,864,905; U.S. Pat. No. 6,134,726.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An expandable table device for allowing a user to care for a baby, said expandable table device comprising:

(a) a base having a first side panel, a second side panel, a top panel, a bottom panel, an open front, and a back panel;

(b) a storage compartment disposed in the base near the top panel;

(c) a table component for supporting a baby slidably disposed in the storage compartment, the table component comprising a base wing connected to a middle wing and an end wing; wherein the table component can move between an expanded position and a retracted position; wherein when the table component is in the expanded position the table component provides a generally flat surface; wherein in the retracted position the middle wing is stacked atop the base wing and the end wing is stacked atop the middle wing; wherein in the expanded position the base wing, middle wing, and end wing are unstacked and are extended outwardly from the storage compartment;

(d) a locking groove disposed on a first side of each of the base wing and the middle wing; a locking tab disposed on a second side of each of the middle wing and the end wing; wherein the locking groove of the base wing is for engaging the locking tab of the middle wing and the locking groove of the middle wing is for engaging the locking tab of the end wing; wherein the locking tab and locking groove both allow the base wing, middle wing, and end wing to be secured together in the expanded position; wherein the end wing is secured on one side to the middle wing while the other side of the end wing is not connected to any other structure; and (e) a track disposed in the storage compartment for slidably enaging the base wing, wherein the track allows the base wing to slide in and out of the storage compartment;

wherein the middle wing has a top edge and a bottom edge; wherein a guide is disposed in the top edge and is for allowing an adjacent wing to slide atop the middle wing or below the middle wing.

* * * * *